US007472980B2

(12) United States Patent
Liao et al.

(10) Patent No.: US 7,472,980 B2
(45) Date of Patent: Jan. 6, 2009

(54) METHOD FOR UPDATING A PRINTING PARAMETER OF A PRINTER

(75) Inventors: Hsieh-Sheng Liao, Yun-Lin Hsien (TW); Cheng-Lung Lee, Taipei (TW)

(73) Assignee: Qisda Corporation, Shan-Ting Tsun, Gueishan Hsiang, Taoyuan County (TW)

( * ) Notice: Subject to any disclaimer, the term of this patent is extended or adjusted under 35 U.S.C. 154(b) by 39 days.

(21) Appl. No.: 11/562,427

(22) Filed: Nov. 22, 2006

(65) Prior Publication Data

US 2007/0115324 A1 May 24, 2007

(30) Foreign Application Priority Data

Nov. 23, 2005 (TW) ..... 94141194 A

(51) Int. Cl.
*B41J 29/393* (2006.01)

(52) U.S. Cl. ..... 347/19

(58) Field of Classification Search ..... 347/19, 347/12, 15, 41
See application file for complete search history.

(56) References Cited

U.S. PATENT DOCUMENTS 6,464,321 B1 * 10/2002 Nunokawa ..... 347/19

FOREIGN PATENT DOCUMENTS

| | | |
|---|---|---|
| EP | 0 901 097 A2 | 3/1999 |
| EP | 0 982 139 A1 | 3/2000 |
| EP | 1 213 153 A1 | 6/2002 |
| EP | 1 454 756 A2 | 9/2004 |

* cited by examiner

*Primary Examiner*—Lamson D Nguyen
(74) *Attorney, Agent, or Firm*—Winston Hsu

(57) ABSTRACT

A method for updating a printing parameter of a printer includes a plurality of nozzles of a row of an inkjet print head of a printer simultaneously printing ink onto a print medium while the inkjet print head is moving along a first horizontal direction or a second horizontal direction opposite to the first horizontal direction; moving the printing medium along a vertical direction less than a center distance between two adjacent nozzles; updating the printing parameter of the printer according to a printing result of the print medium. The method can be adjusted to match resolution of an image having a higher resolution than the inkjet print head, also the method can perform printing adjustment even when the inkjet print head is out of alignment, in this way a more accurate printing parameter can be obtained.

8 Claims, 21 Drawing Sheets

METHOD FOR UPDATING A PRINTING PARAMETER OF A PRINTER

BACKGROUND OF THE INVENTION

1. Field of the Invention

The present invention relates to a method for updating a printing parameter of a printer, and more particularly, to a method for updating a printing parameter of a printer according to a printing result on a printing medium.

2. Description of the Prior Art

A printer that prints images by propelling ink utilizes an inkjet print head moving in horizontal directions to propel ink onto a print medium (i.e., such as paper) to perform the printing operation. In this operation, ink is propelled out of the inkjet print head where it falls onto the print medium along a movement track of a propel line. When a printing parameter of the printer is not properly set, a phenomenon of a slanted image outputted by the printer occurs, thus an action of printing adjustment has to be executed for the printer that prints image by propelling ink.

Please refer to FIG. 1 through FIG. 3. FIG. 1 illustrates a diagram of an inkjet print head 100 of a conventional printer propelling ink onto a print medium 110 during a first printout. FIG. 2 illustrates a diagram of the inkjet print head 100 of FIG. 1 propelling ink onto the print medium 110 during a second printout. FIG. 3 illustrates a diagram of the inkjet print head 100 of FIG. 1 propelling ink onto the print medium 110 during a third printout. As illustrated in the figures, in order to execute the action of printing adjustment, the inkjet print head 100 of the printer is required to perform printing several times to determine whether a straight line printed is slanted. For example, a plurality of first nozzles 102 in a first row and a plurality of second nozzles 104 in a second row of the inkjet print head 100 during the first printout move horizontally forward to print a first straight line 112 (e.g., the line which is formed by a plurality of ink dots 1*a*) onto the print medium 110, and during the second printout the plurality of first nozzles 102 and the plurality of second nozzles 104 of the inkjet print head 100 move horizontally backwards to print a second straight line 114 (e.g., the line which is formed by a plurality of ink dots 2*a*) onto the print medium 110, then the plurality of first nozzles 102 and the plurality of second nozzles 104 of the inkjet print head 100 move horizontally forward during the third printout to print a third straight line 116 (e.g., the line which is formed by a plurality of ink dots 3*a*) onto the print medium 110, and so forth. Please refer to FIG. 4. FIG. 4 illustrates a straight line printed by a conventional printer during printing adjustment. When a printout is completed, a user or an image detector can select the best line from a plurality of straight lines (such as a straight line A1-G1) to determine the most suitable printer parameter. However, as shown in FIG. 5, when the straight line printed is slanted there is the possibility that the inkjet print head 100 of the printer is out of alignment, or there is a problem with the position of the ink carriage). The result is that the user is not able to view or utilize the image detector to select the best line from a plurality of straight lines (such as a straight line A2-G2) to determine the most suitable printer parameter. Furthermore, the resolution of a straight line printed during adjustment is identical to the resolution of the inkjet print head of the printer, therefore the conventional method can only be utilized for adjusting the resolution of an image identical to the inkjet print head 100 of the printer, when the inkjet print head of the printer is utilized to print a high resolution image. The above-mentioned method is not able to provide an adjustment function.

SUMMARY OF THE INVENTION

The claimed invention discloses a method for updating a printing parameter of a printer. The method comprises a plurality of nozzles of a row of an inkjet print head of a printer simultaneously printing ink onto a print medium when the inkjet print head of the printer is moving in a first horizontal direction; moving the print medium along a vertical direction a distance less than a center distance between two adjacent nozzles; a plurality of nozzles of a row of the inkjet print head simultaneously printing ink on the print medium when the inkjet print head is moving in a second horizontal direction opposite to the first horizontal direction; and updating the printing parameter of the printer according to printing results on the print medium.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
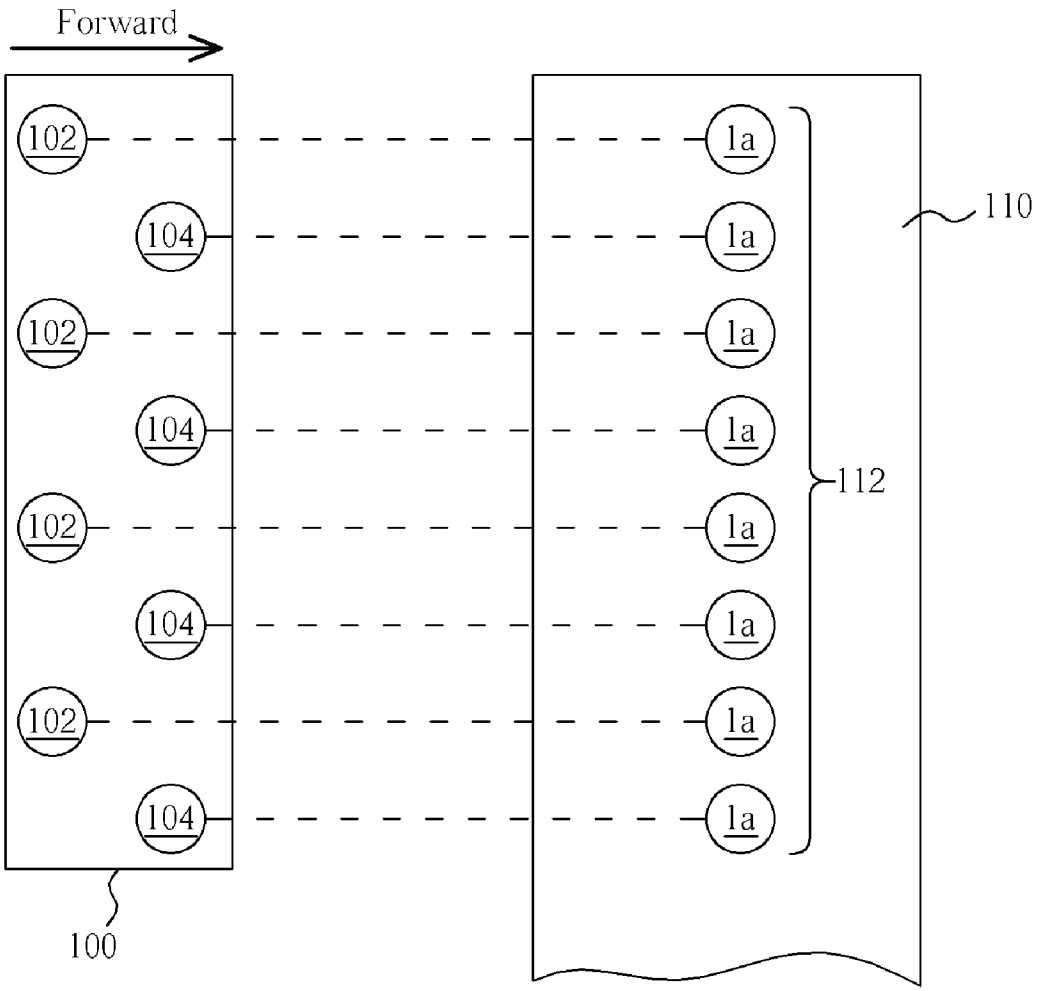
Fig. 1 Prior Art
FIG. 1 illustrates a diagram of an inkjet print head of a conventional printer propelling ink onto a print medium during a first printout.
Figure 2:
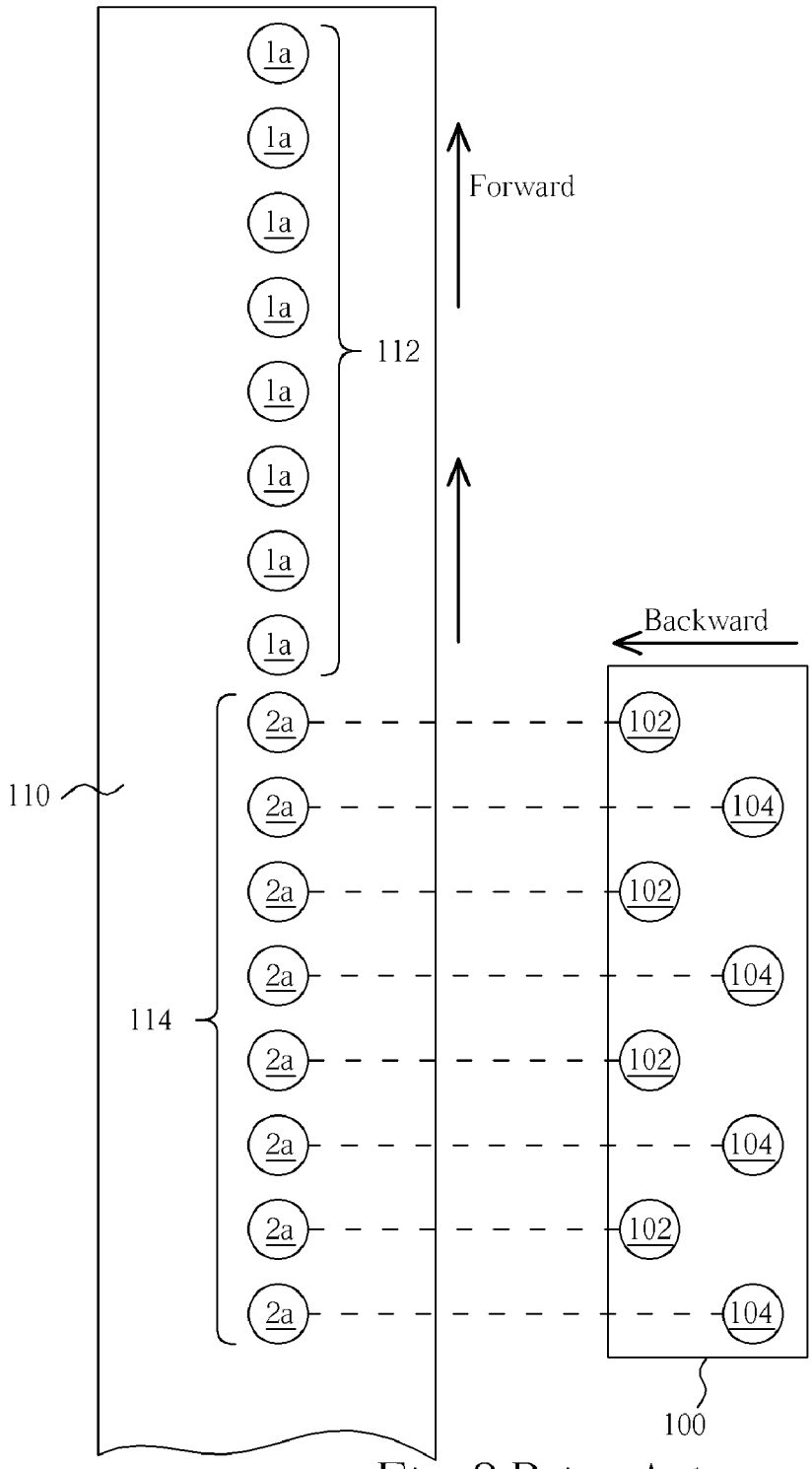
Fig. 2 Prior Art
FIG. 2 illustrates a diagram of the inkjet print head of FIG. 1 propelling ink onto the print medium during a second printout.
Figure 3:
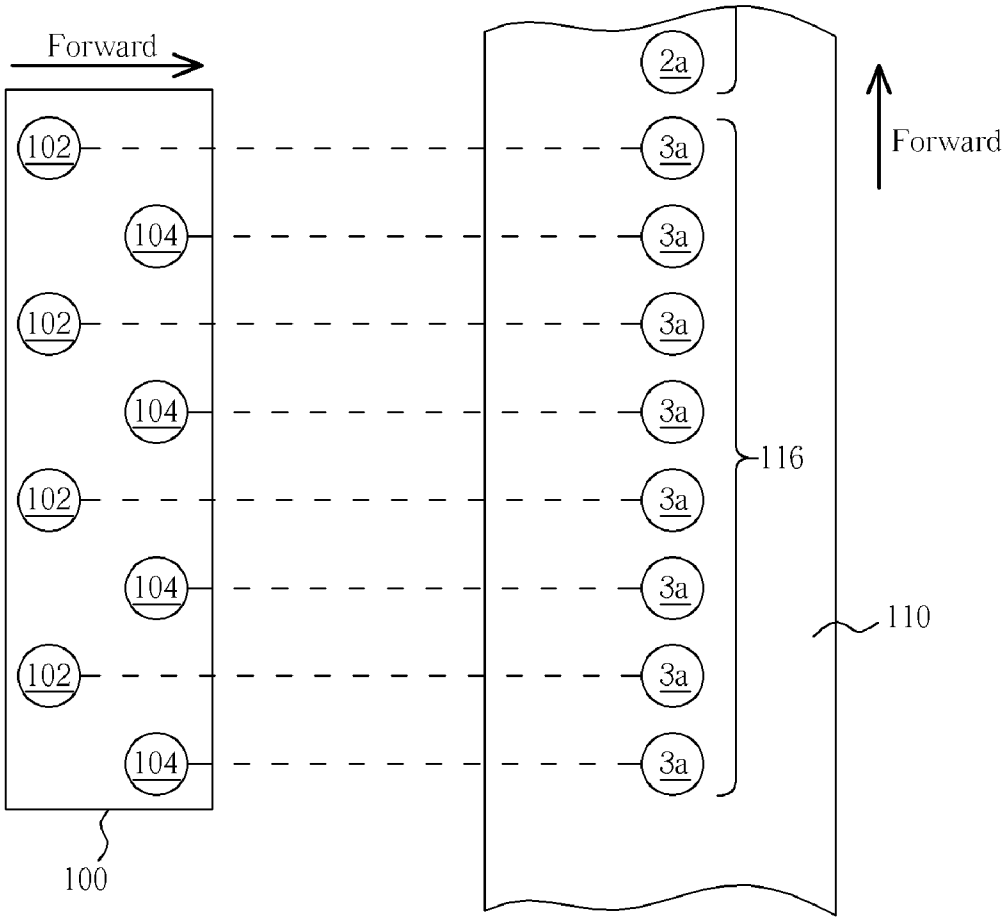
Fig. 3 Prior Art
FIG. 3 illustrates a diagram of the inkjet print head of FIG. 1 propelling ink onto the print medium during a third printout.
Figure 4:
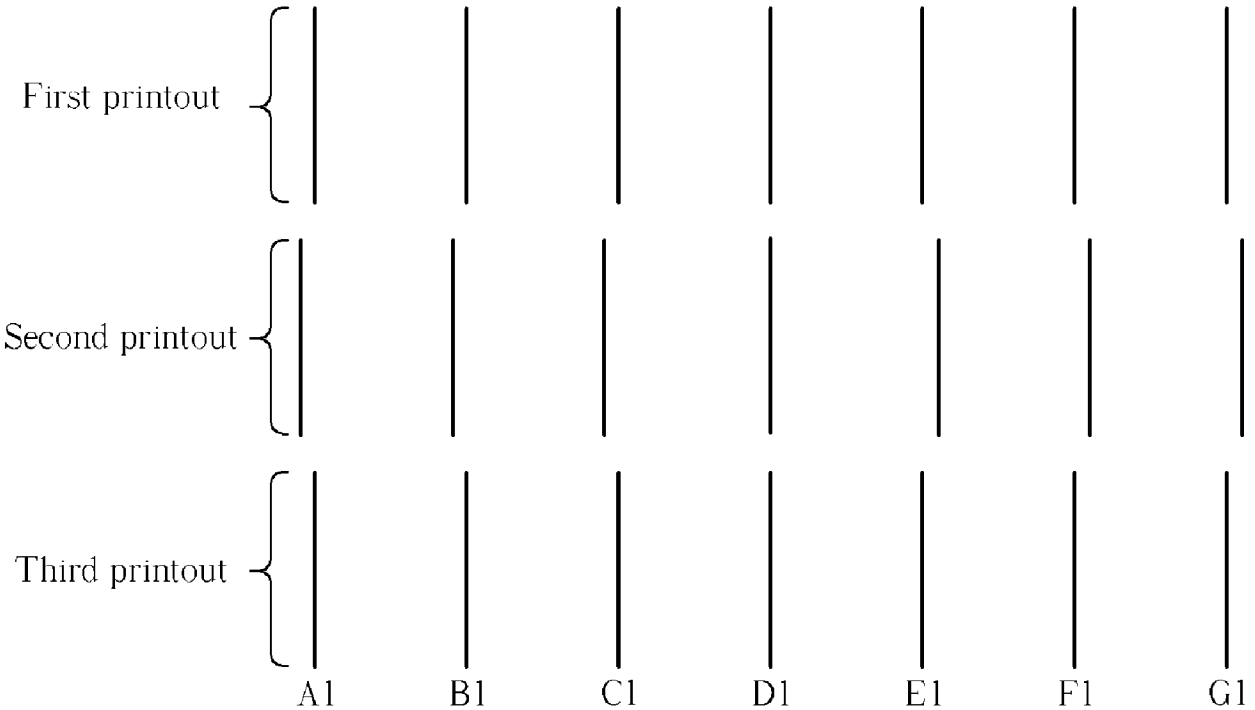
Fig. 4 Prior Art
FIG. 4 illustrates a diagram of a straight line printed by a conventional printer during printing adjustment.
Figure 5:
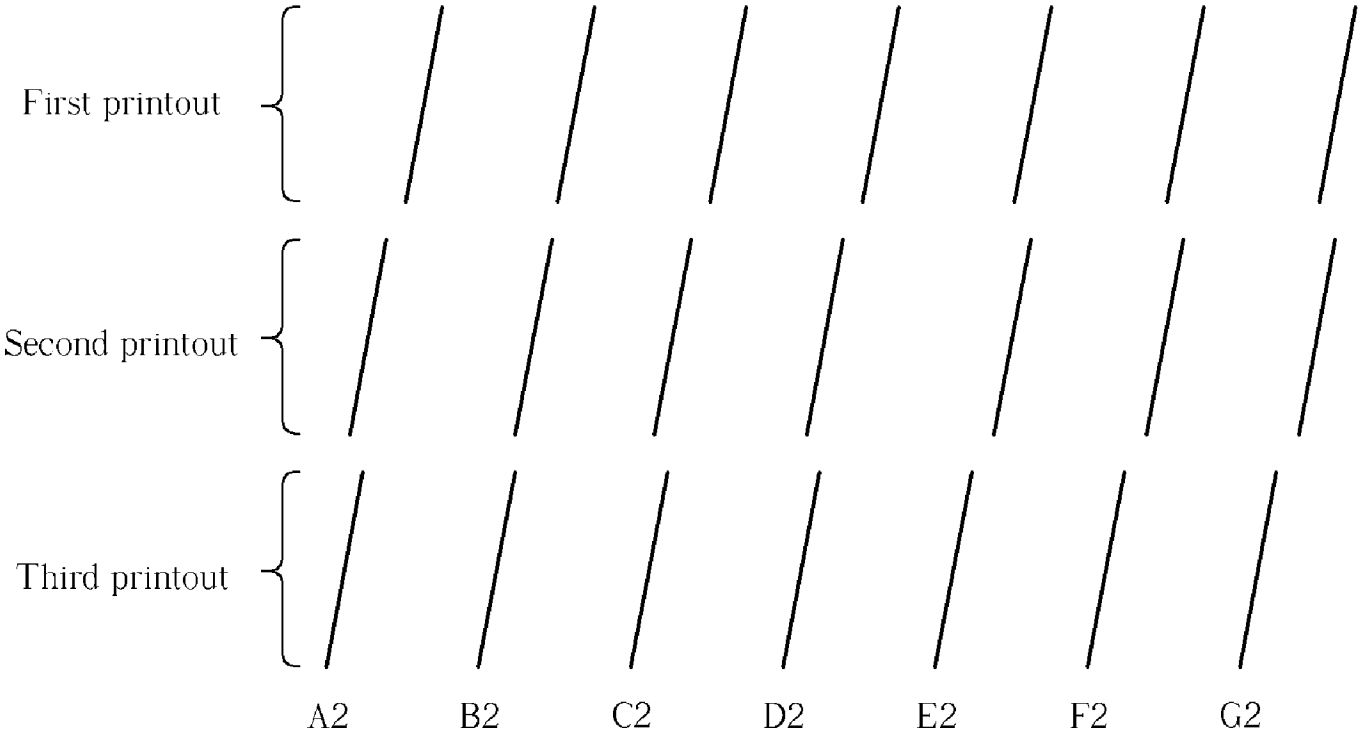
Fig. 5 Prior Art
FIG. 5 illustrates a diagram of a straight line printed by a conventional printer when an inkjet print head is slanted.
Figure 6:
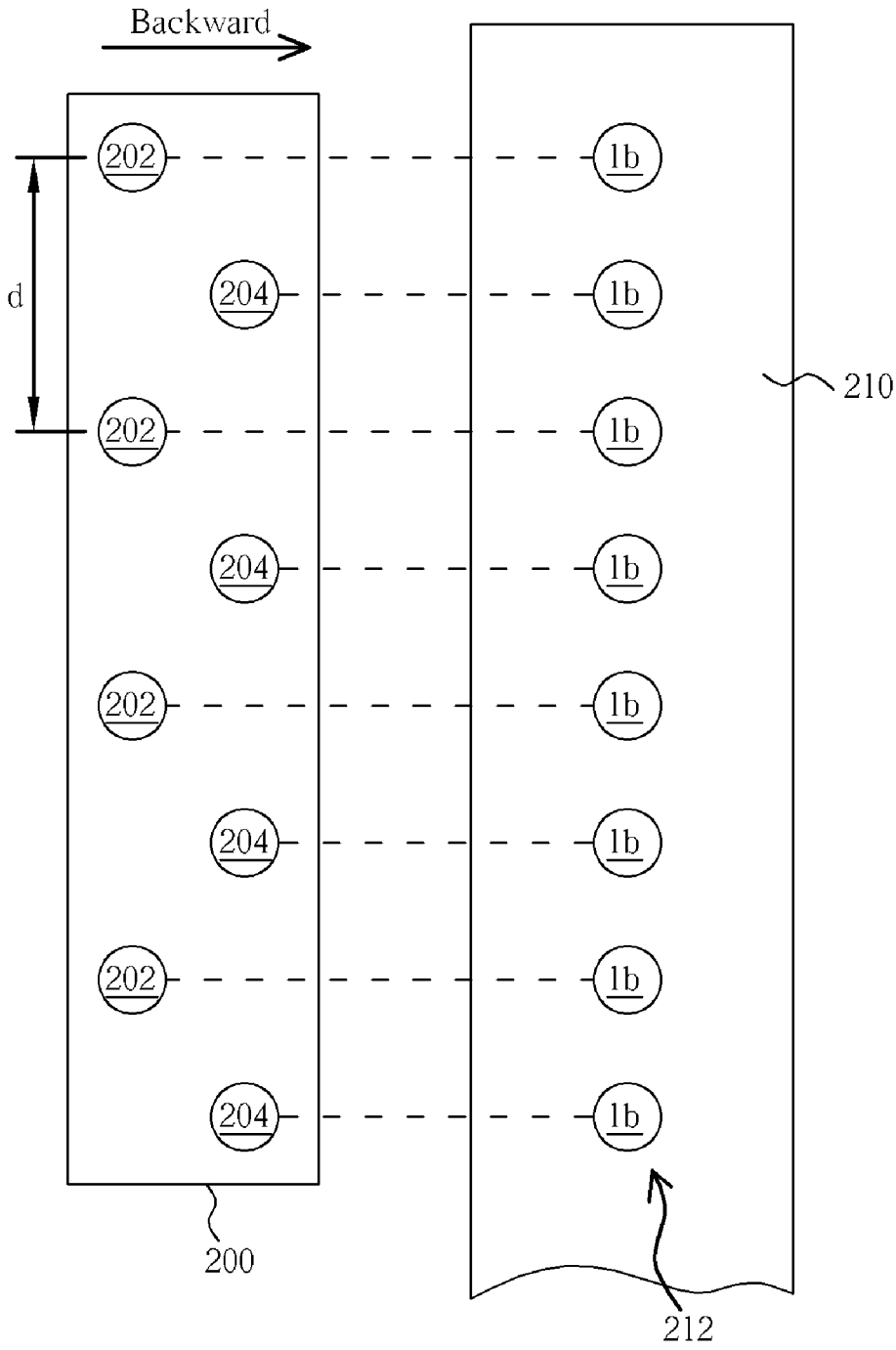
FIG. 6 illustrates a diagram of an inkjet print head of a printer propelling ink onto a print medium during a first printout according to the present invention.
Figure 7:
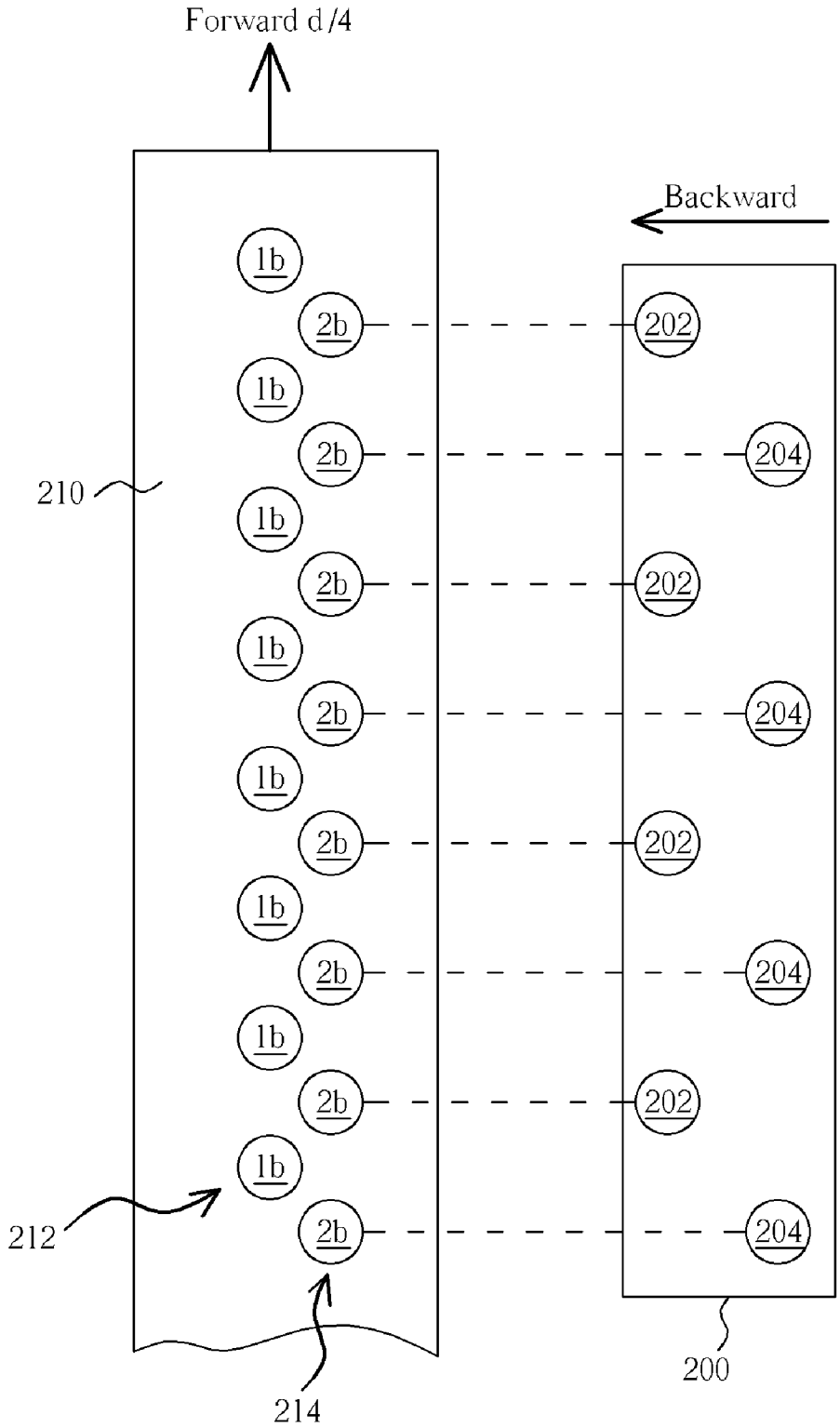
FIG. 7 illustrates a diagram of the inkjet print head of FIG. 6 propelling ink onto the print medium during a second printout.
Figure 8:
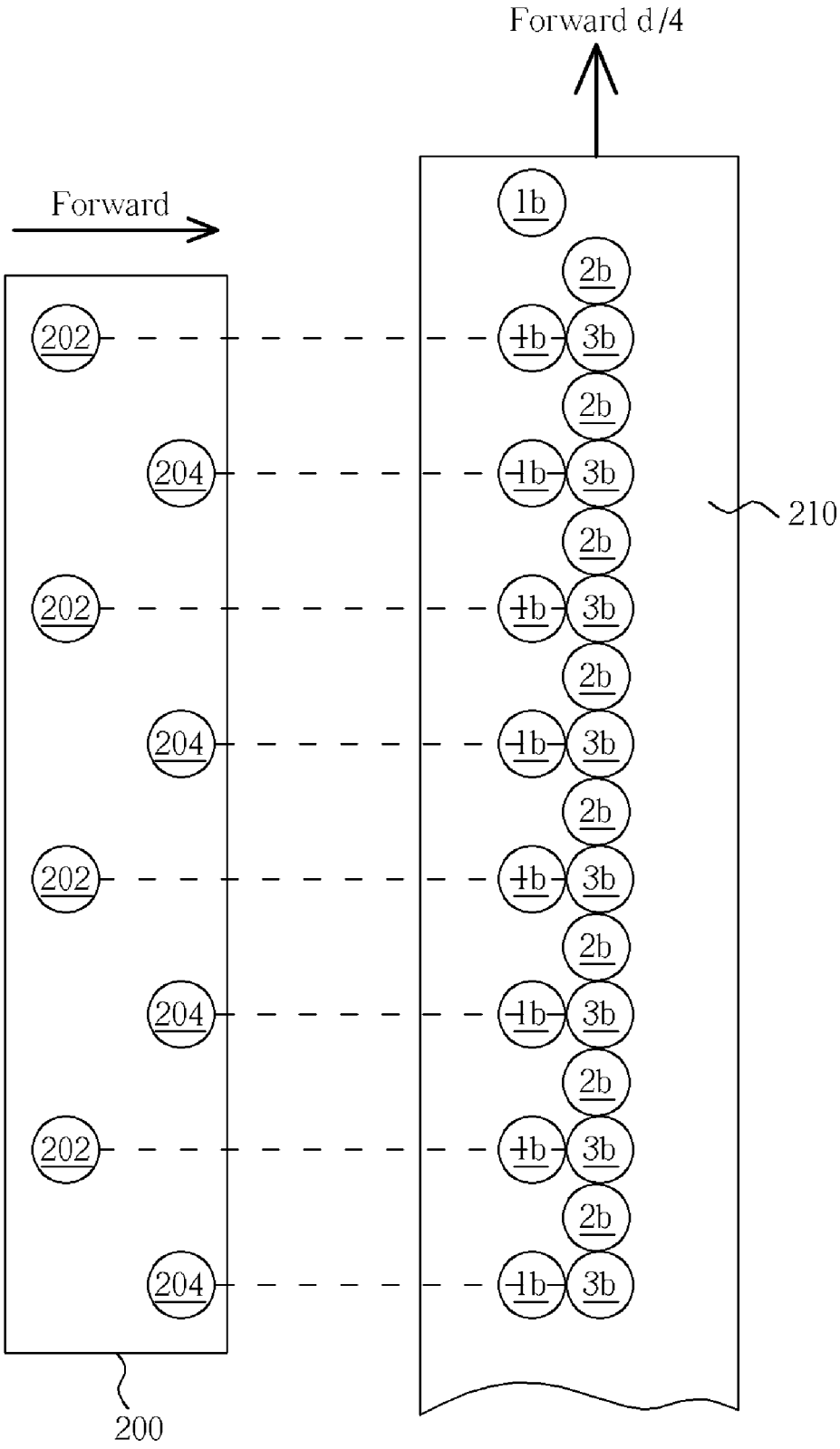
FIG. 8 illustrates a diagram of the inkjet print head of FIG. 6 propelling ink onto the print medium during a third printout.
Figure 9:
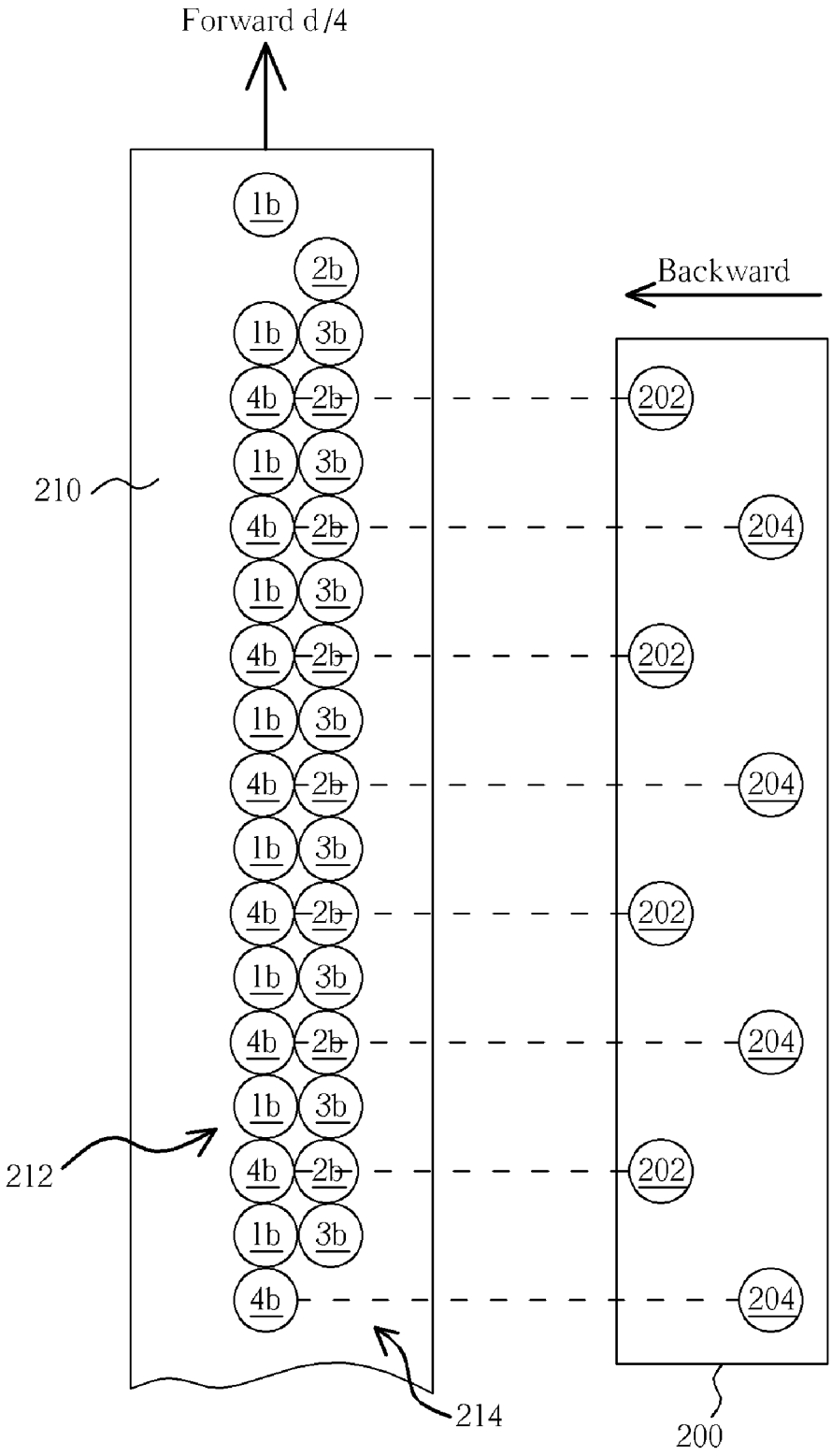
FIG. 9 illustrates a diagram of the inkjet print head of FIG. 6 propelling ink onto the print medium during a fourth printout.

Please refer to FIG. 6 through FIG. 9. FIG. 6 illustrates a diagram of an inkjet print head 200 of a printer propelling ink onto a print medium 210 during a first printout according to the present invention. FIG. 7 illustrates a diagram of the inkjet print head 200 of FIG. 6 propelling ink onto the print medium 210 during a second printout. FIG. 8 illustrates a diagram of the inkjet print head 200 of FIG. 6 propelling ink onto the print medium 210 during a third printout. FIG. 9 illustrates a diagram of the inkjet print head 200 of FIG. 6 propelling ink onto the print medium 210 during a fourth printout. As illustrated in the figures, when the present invention performs a printing adjustment, a plurality of first nozzles 202 of a first row and a plurality of second nozzles 204 of a second row of the inkjet print head 200 during the first printout move horizontally forward to print a plurality of ink dots 1*b* on a first straight line 212, and during the second printout the plurality of first nozzles 202 and the plurality of second nozzles 204 of the inkjet print head 200 move horizontally backwards to print a plurality of ink dots 2*b* on a second straight line 214, then the plurality of first nozzles 202 and the plurality of second nozzles 204 of the inkjet print head 200 move horizontally forward during the third printout to print a plurality of ink dots 3*b* in between the ink dots 2*b*, and the plurality of first nozzles 202 and the plurality of second nozzles 204 of the inkjet print head 200 move horizontally backwards during the fourth printout to print a plurality of ink dots 4*b* in between the ink dots 1*b*. Furthermore, the print medium 210 moves along a vertical direction a distance less than a center distance *d* between two adjacent nozzles of the same row after each printout, for example if a quarter (d/4) of the center distance d is moved between two adjacent nozzles of the same row, the method of the present invention can then be utilized for adjusting an image with resolution higher than the inkjet print head.

Figure 10:
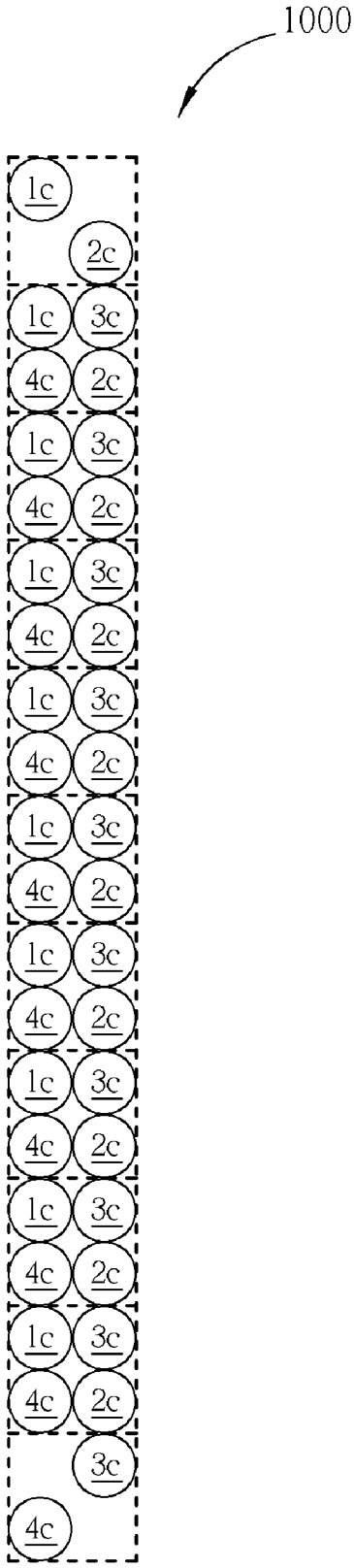
FIG. 10 illustrates a diagram of a straight line having an accurate adjustment value after printing according to the method of the present invention.
Figure 11:
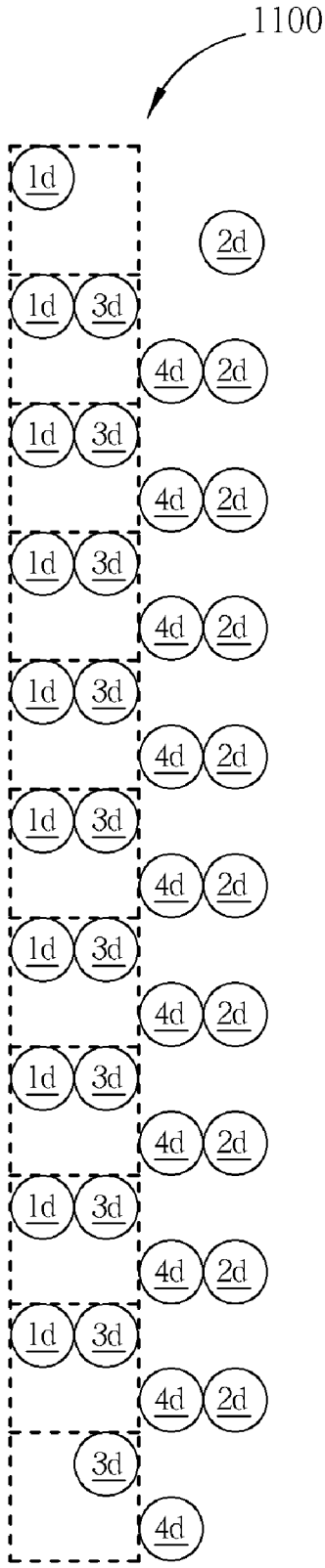
FIG. 11 illustrates a straight line having an error adjustment value after printing according to the method of the present invention.

Please refer to FIG. 10 and FIG. 11. FIG. 10 illustrates a diagram of a straight line 1000 having an accurate adjustment value after printing according to the method of the present invention. FIG. 11 illustrates a straight line 1100 having an error adjustment value after printing according to the method of the present invention. After the above-mentioned printing steps, a user can view or utilize an image detector to select the preferred printed result. As shown in FIG. 10, ink dots 1*c*-4*c* of the first to fourth printout are located within a predetermined printing range, therefore the user can update the printing parameter of the printer according to the settings of FIG. 10. And as shown in FIG. 11, ink dots 1*d*-4*d* of the first to fourth printout are located out of the predetermined printing range, therefore, there is a problem with the printing parameter of the printer of FIG. 11.

Figure 12:
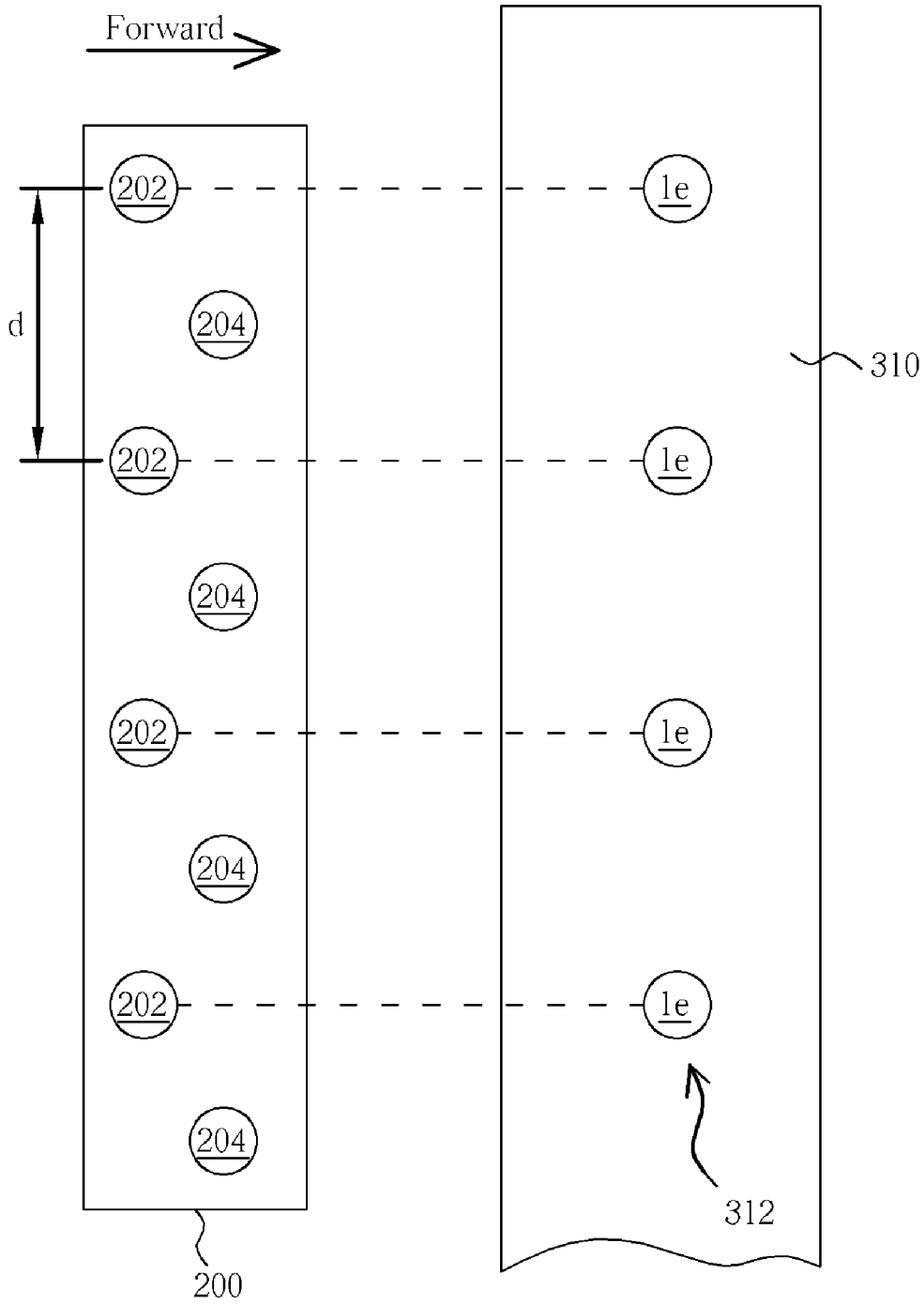
FIG. 12 illustrates a diagram of first nozzles of an inkjet print head of a printer propelling ink onto a print medium during a first printout.
Figure 13:
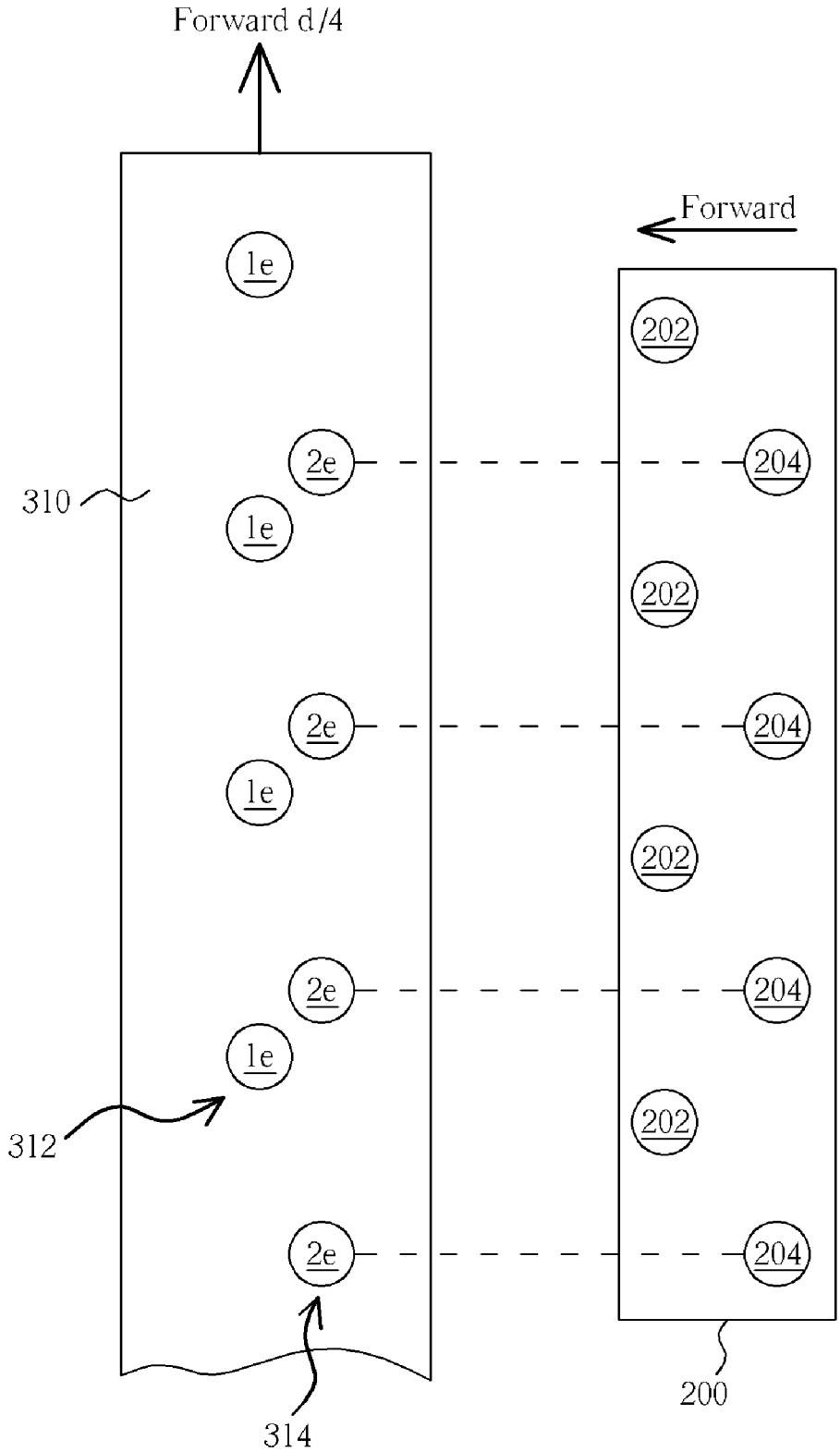
FIG. 13 illustrates a diagram of second nozzles of the inkjet print head of FIG. 12 propelling ink onto the print medium during a second printout.
Figure 14:
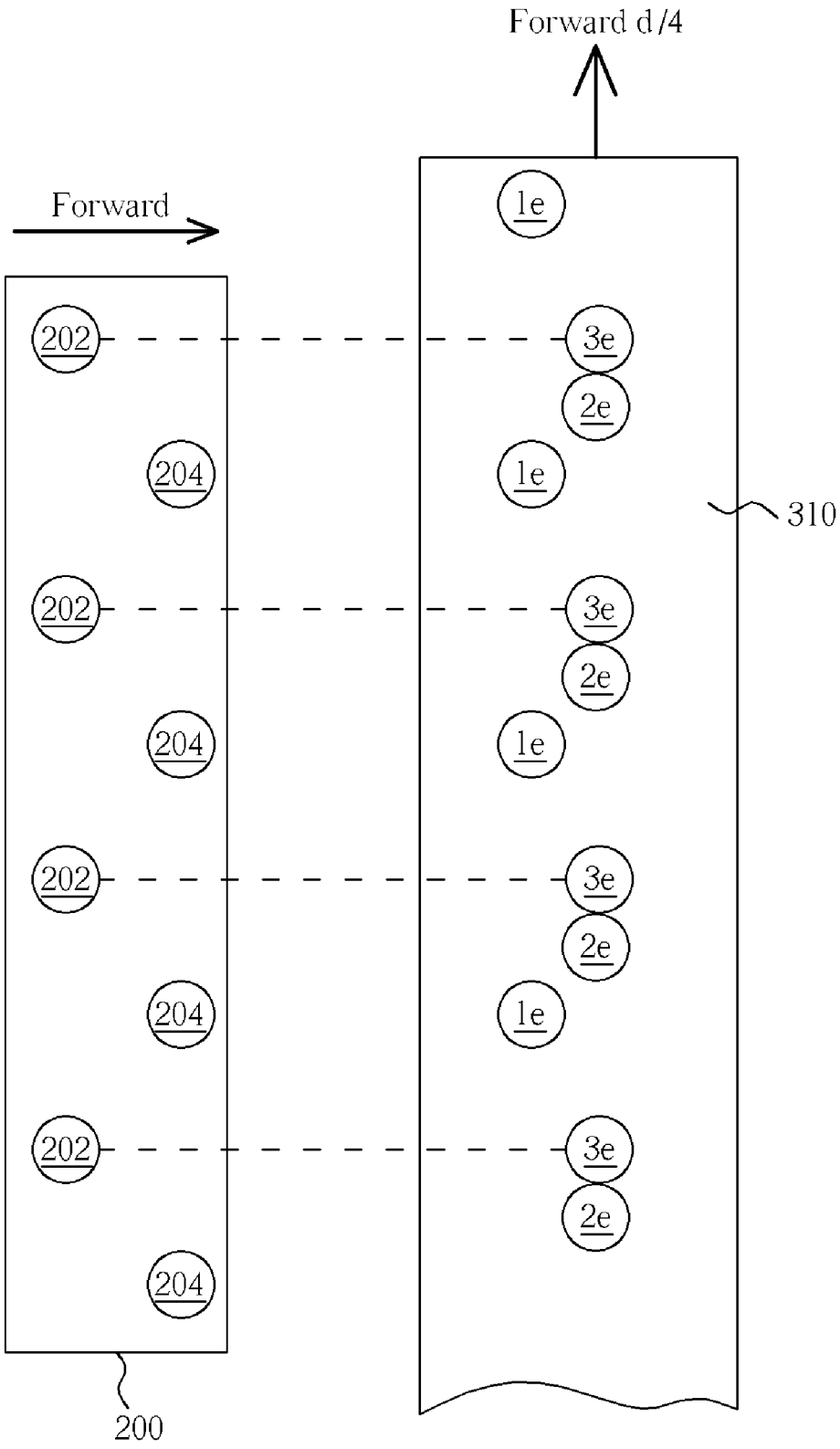
FIG. 14 illustrates a diagram of the first nozzles of the inkjet print head of FIG. 12 propelling ink onto the print medium during a third printout.
Figure 15:
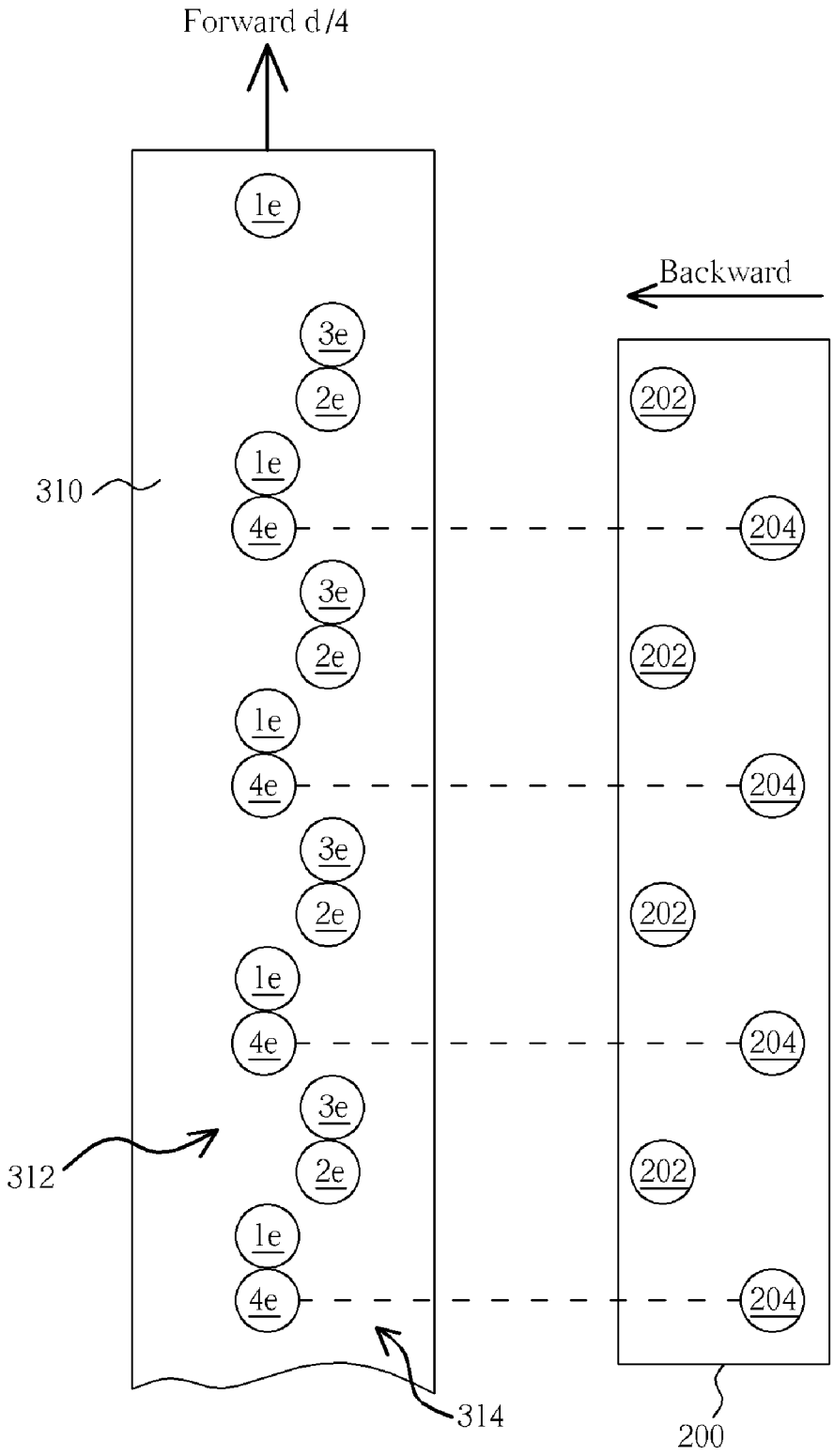
FIG. 15 illustrates a diagram of the second nozzles of the inkjet print head of FIG. 12 propelling ink onto the print medium during a fourth printout.

In order to prevent excess ink being propelled on a single surface area of the print medium, which can cause the print medium to be damp, the method of the present invention can drive only a portion of the nozzles during each printout. Please refer to FIG. 12 through FIG. 15. FIG. 12 illustrates a diagram of first nozzles 202 of an inkjet print head 200 of a printer propelling ink onto a print medium 310 during a first printout. FIG. 13 illustrates a diagram of second nozzles 204 of the inkjet print head 200 of FIG. 12 propelling ink onto the print medium 310 during a second printout. FIG. 14 illustrates a diagram of the first nozzles 202 of the inkjet print head 200 of FIG. 12 propelling ink onto the print medium 310 during a third printout. FIG. 15 illustrates a diagram of the second nozzles 204 of the inkjet print head 200 of FIG. 12 propelling ink onto the print medium 310 during a fourth printout. As illustrated in the figures, the plurality of first nozzles 202 of the inkjet print head 200 during a first printout moves horizontally forward to print a plurality of ink dots 1*e* on a first straight line 312, and the plurality of second nozzles 204 of the inkjet print head 200 during a second printout moves horizontally backwards to print a plurality of ink dots 2*e* on a second straight line 314, then the plurality of first nozzles 202 of the inkjet print head 200 moves horizontally forward during a third printout to print a plurality of ink dots 3*e* above the ink dots 2*e*, and the plurality of second nozzles 204 of the inkjet print head 200 move horizontally backwards during a fourth printout to print a plurality of ink dots 4*e* below the ink dots 1*e*. The print medium 310 moves in a vertical direction similar to the above-mentioned steps after each printout.

Figure 16:
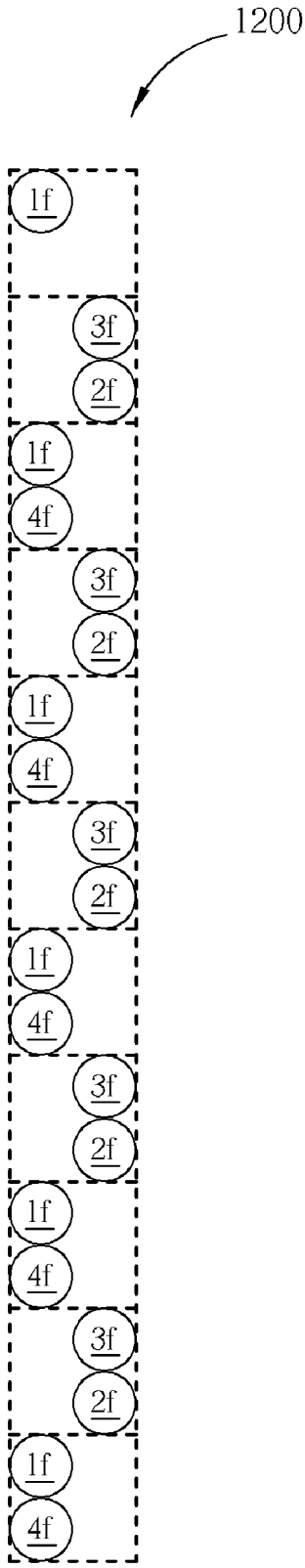
FIG. 16 illustrates a diagram of a straight line having an accurate adjustment value after a portion of the nozzles is driven to print.
Figure 17:
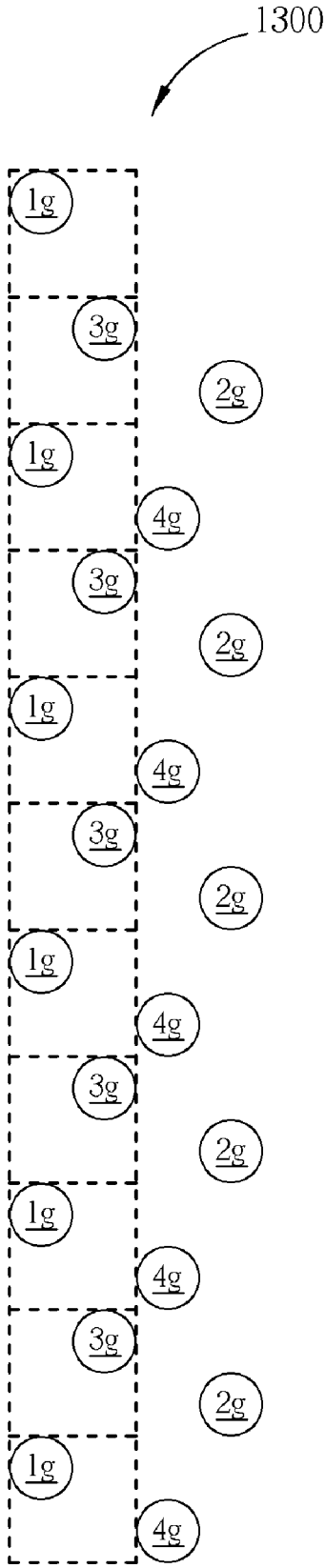
FIG. 17 illustrates a straight line having an error adjustment value after a portion of nozzles is driven to print.

Please refer to FIG. 16 and at the same time refer to FIG. 17. FIG. 16 illustrates a diagram of a straight line 1200 having an accurate adjustment value after a portion of the nozzles is driven to print. FIG. 17 illustrates a straight line 1300 having an error adjustment value after a portion of nozzles is driven to print. As shown in FIG. 16, ink dots 1*f*-4*f* of first to fourth printout are located within a predetermined printing range, therefore, the user can update the printing parameter of the printer. As shown in FIG. 17, ink dots 1*g*-4*g* of first to fourth printout are located out of the predetermined printing range, therefore, there is a problem with the printing parameter of the printer of FIG. 17.

Figure 18:
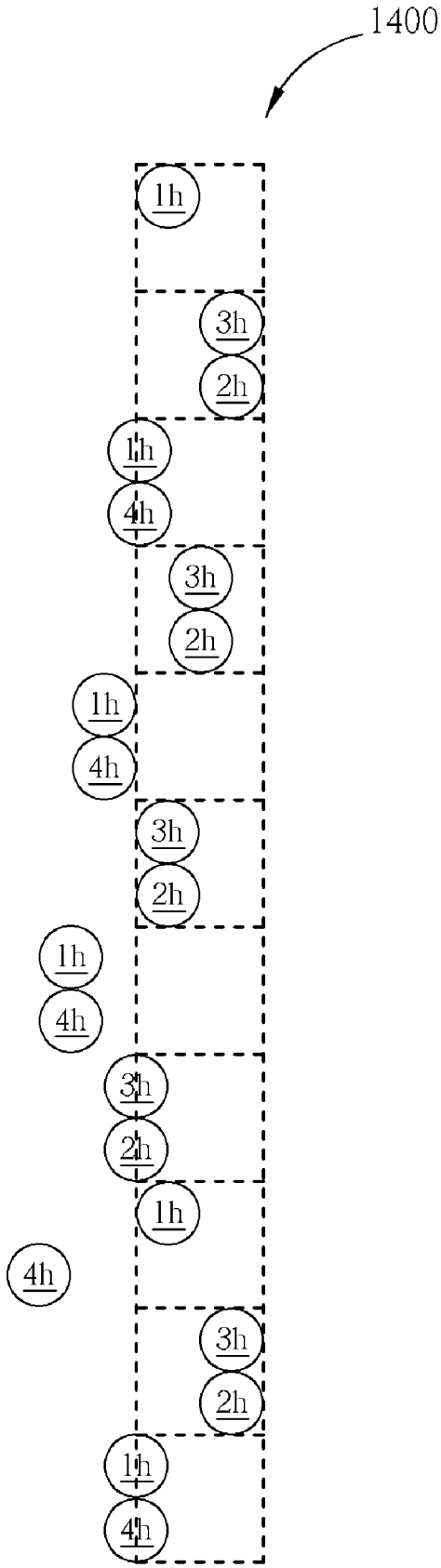
FIG. 18 illustrates a diagram of a straight line having an accurate adjustment value when an inkjet print head is out of alignment.
Figure 19:
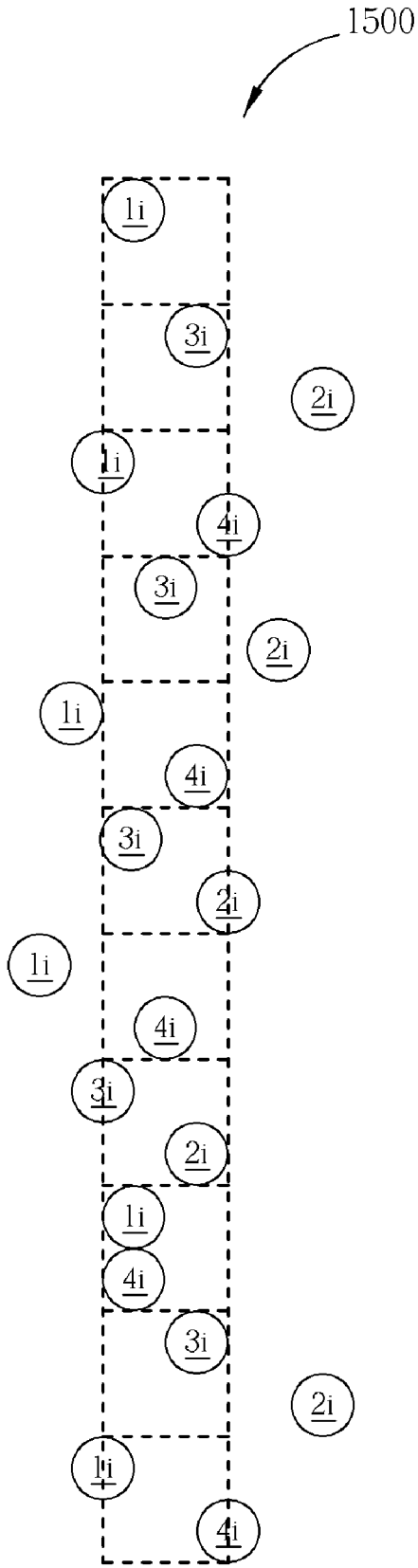
FIG. 19 illustrates a diagram of a straight line having an error adjustment value when an inkjet print head is out of alignment.

The situation of FIG. 10 and FIG. 11 and the situation of FIG. 16 and FIG. 17 is the result of the inkjet print head's alignment. However, the method of the present invention can also perform printing adjustment when the inkjet print head is out of alignment. Please refer to FIG. 18 and FIG. 19. FIG. 18 illustrates a diagram of a straight line 1400 having an accurate adjustment value when an inkjet print head is out of alignment. FIG. 19 illustrates a diagram of a straight line 1500 having an error adjustment value when an inkjet print head is out of alignment. As illustrated in the figures, although ink dots 1*h*-4*h* printed in FIG. 18 and ink dots 1*i*-4*i* printed in FIG. 19 are slanted, but the ink dots 1*h*-4*h* of FIG. 18 are closer to the predetermined printing range than the ink dots 1*i*-4*i* of FIG. 19, therefore, the user can update the printing parameter of the printer according to the settings of FIG. 18, and the printing parameter of FIG. 19 is an error parameter.

Figure 20:
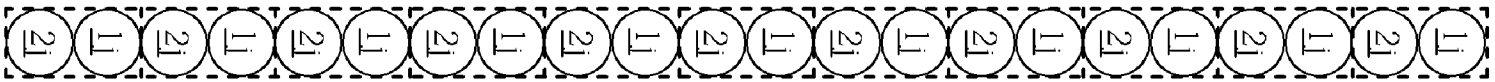
FIG. 20 illustrates a diagram of a printing adjustment being executed during a second printout according to the present invention.
Figure 21:
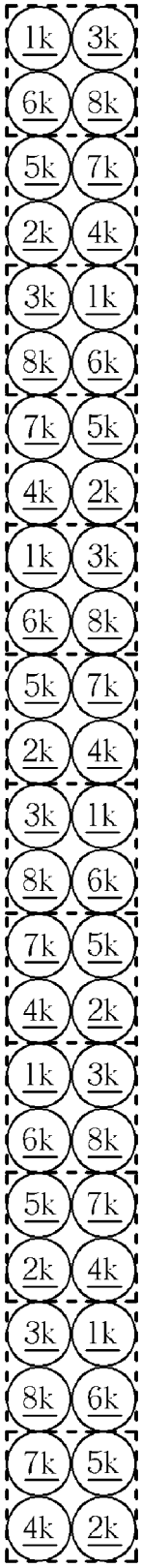
FIG. 21 illustrates a diagram of a printing adjustment being executed during an eighth printout according to the present invention.

Furthermore, the method of the present invention is not limited to performing the printing adjustment in four printouts, the present invention can also perform the printing adjustment in a plurality of printouts as illustrated in FIG. 20 and FIG. 21. As illustrated in the figures, FIG. 20 performs only two printouts, whereas FIG. 21 performs eight printouts.

In conclusion, the present invention provides a method for updating a printing parameter of a printer, the present invention performs a plurality of continuous printouts, and ink dots of each printout are printed in between ink dots of other printouts. The present invention then adjusts the printing parameter of the printer according to the printing results. The results are being detected by viewing or an image detector.

In comparison to the prior art, the method of the present invention can be adjusted to match resolution of an image having a higher resolution than the inkjet print head, and the method of the present invention can also perform printing adjustment even when the inkjet print head is out of alignment, hence the method of the present invention can obtain a more accurate printing parameter.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for updating a printing parameter of a printer, the method comprising following steps:

(a) a plurality of first nozzles of a row of an inkjet print head of a printer simultaneously printing ink onto a print medium when the inkjet print head of the printer is moving in a first horizontal direction;

(b) after executing step (a), moving the print medium along a vertical direction a distance less than a center distance between two adjacent nozzles;

(c) after executing step (b), a plurality of second nozzles of a row of the inkjet print head simultaneously printing ink onto the print medium when the inkjet print head is moving in a second horizontal direction opposite to the first horizontal direction, wherein the plurality of first nozzles are different from the plurality of second nozzles; and (d) updating the printing parameter of the printer according to a result of step (a) and step (c).

2. The method of claim 1 wherein step (b) is after executing step (a), moving the print medium along the vertical direction one quaffer of the center distance between the two adjacent nozzles.

3. The method of claim 1 further comprising an image detector detecting an image generated from step (a) and (c), wherein step (d) is updating the printing parameter of the printer according to a result detected by the image detector.

4. The method of claim 1 further comprising viewing an image generated from step (a) and (c), wherein step (d) is updating the printing parameter of the printer according to a result determined from viewing.

5. A method for updating a printing parameter of a printer, the method comprising following steps:

(a) an inkjet print head of a printer printing a plurality of dots on a first straight line with a plurality of first nozzles positioned in a first row of the inkjet print head;

(b) the inkjet print head of the printer printing a plurality of dots on a second straight line with a plurality of second nozzles positioned in a second row of the inkjet print head, the plurality of dots on the first straight line alternating with the plurality of dots on the second straight line in a vertical direction; and (c) updating the printing parameter of the printer according to a result of step (a) and (b).

6. The method of claim 5 further comprising viewing an image generated from step (a) and (b), wherein step (c) is updating the printing parameter of the printer according to a result determined from viewing.

7. The method of claim 5 further comprising an image detector detecting an image generated from step (a) and (b), wherein step (c) is updating the printing parameter of the printer according to a result detected by the image detector.

8. The method of claim 5 wherein step (a) is the inkjet print head printing the plurality of dots on the first straight line by moving forward in a horizontal direction, and step (b) is the inkjet print head printing the plurality of dots on the second straight line by moving backward in the horizontal direction, the plurality of dots on the first straight line alternating with the plurality of dots on the second straight line in the vertical direction.

* * * * *